US005451966A

United States Patent [19]

Du et al.

[11] Patent Number: 5,451,966

[45] Date of Patent: Sep. 19, 1995

[54] ULTRA-HIGH FREQUENCY, SLOT COUPLED, LOW-COST ANTENNA SYSTEM

[75] Inventors: Xin Du, Glen Ellyn; Joseph F. Mockus, North Riverside, both of Ill.

[73] Assignee: The Antenna Company, Itasca, Ill.

[21] Appl. No.: 311,148

[22] Filed: Sep. 23, 1994

[51] Int. Cl.[6] ..... H01Q 1/32

[52] U.S. Cl. ..... 343/715; 343/713; 333/24 C

[58] Field of Search ..... 343/700 MS, 713, 715, 343/829, 830, 846, 848, 860, 863; 333/24 C, 246; H01Q 1/32

[56] References Cited

U.S. PATENT DOCUMENTS

| | | | |
|---|---|---|---|
| Re. 33,743 | 11/1991 | Blaese | 343/715 |
| 4,089,817 | 5/1978 | Kirkendan | 343/713 |
| 4,238,799 | 12/1980 | Parfitt | 343/715 |
| 4,621,243 | 11/1986 | Harada | 333/24 C |
| 4,764,773 | 8/1988 | Larsen | 343/713 |
| 4,785,305 | 11/1988 | Shyu | 343/713 |
| 4,839,660 | 6/1989 | Madzoglou | 343/715 |
| 4,857,939 | 8/1989 | Shimazakz | 343/715 |
| 4,931,805 | 6/1990 | Fisher | 343/713 |
| 4,931,806 | 6/1990 | Wunderlich | 343/713 |
| 4,939,484 | 7/1980 | Marada | 333/24 R |
| 4,992,800 | 2/1991 | Parfitt | 343/713 |
| 5,043,738 | 8/1991 | Shapiro | 343/700 MS |
| 5,059,971 | 10/1991 | Blaese | 343/713 |
| 5,099,252 | 3/1992 | Bryant et al. | 343/715 |

OTHER PUBLICATIONS

Electronics Letters, vol. 21, No. 2, pp. 49–50 Jan. 17, 1985.

IEEE Transactions, vol. AP-34, No. 8, pp. 977–984, Aug. 1986 "Analysis of an Aperture Coupled Microstrip Antenna", Sullivan et al.

IEEE Transactions, vol. AP-34, No. 12, pp. 1439–1444, Dec. 1986, "A Reciprocity Method of Analysis for Printed Slot and Slot-Coupled Microstrip Antenna", Pozar.

Electronics Letters, vol. 24, No. 23, pp. 1433–1446, Nov. 10, 1986.

Electronics Letters, vol. 27, No. 13, pp. 1129–1131, Jun. 20, 1991.

IEEE Transactions, vol. 40, No. 5, pp. 469–481, May 1992 "Multiport Scattering Analysis of General Multi--layered Printed Antennas Fed by Multiple Feed Ports, Part I" Das et al.

IEEE Transactions, vol. 40, No. 5, pp. 482–491, May 1992.

IEEE Transactions, vol. 41, No. 2, pp. 214–220, Feb. 1993 "Design of Wideband Circularly Polarized Aperture-Coupled Microstrip Antennas", Targonski et al.

Rogers Corporation Preliminary Data Sheet—RO3000 TM High Frequency Circuit Material 1993.

*Primary Examiner*—Donald Hajec

*Assistant Examiner*—Tan Ho

*Attorney, Agent, or Firm*—Lockwood, Alex, Fitzgibbon & Cummings

[57] ABSTRACT

An improved glass mount antenna system employs a pair of coupling plates having planar cavities disposed therein with any ground plane portion thereof. Surfaces of the coupling plates which are opposite that of the ground plane include a printed exciter strip which crosses the planar cavities to thereby provide an effective communications antenna assembly which is inexpensive to manufacture and especially well suited for high frequency communication operations such as the ultra-high frequency microwave bands of between 1.5 GHz and about 2.4 GHz which are currently intended for PCN/PCS communications.

20 Claims, 6 Drawing Sheets

ULTRA-HIGH FREQUENCY, SLOT COUPLED, LOW-COST ANTENNA SYSTEM

BACKGROUND OF THE INVENTION

The present invention relates generally to radio frequency (RF) signal transmissions through a dielectric barrier, such as a vehicle windshield, and more particularly relates to an improved, low-cost glass mount mobile antenna system.

The expansion of mobile and personal cellular telephones or telephone systems has been rapid and widespread during the last few years. Originally, cellular telephone systems were designed to provide communication services primarily to vehicles and thus replace mobile radio telecommunication systems. Advancements in technology and production have significantly decreased the cost of cellular service to the point at which cellular telephone service has now become affordable to a majority of the general population. Therefore, the "cellular telephone system" no longer strictly refers to cellular telephones, which originally were physically attached to and made a part of a vehicle. Cellular telephone service now includes portable, personal telephones which may be carried in a pocket or purse and which may be easily used inside or outside a vehicle or building.

One ultimate goal of the communications industry is to broaden the scope of cellular communication services by providing individuals with small, inexpensive, hand-held communicators by which the users may be reachable by voice or data communications with a single phone number, irrespective the location of the user. This proposed system has been generally referred to as a personal communication network/personal communication system ("PCN/PCS"). The PCN/PCS system is envisioned to be a wireless, "go anywhere" communication system which should for all intents and purposes eliminate the need for separate numbers for the office, home, pager, facsimile or car.

In anticipation of the development of PCN/PCS, many countries and communications providers have agreed upon international communication standards and have set aside a portion of the ultra-high frequency microwave radio spectrum as the bandwidth range which is to be exclusively dedicated for use by PCN/PCS. The entire bandwidth range expected to be used in PCN/PCS on a worldwide basis extends from about 1.5 GHz to about 2.4 GHz and individual countries have set aside different ranges, or bandwidths within this overall bandwidth for their national operations. For example, Japan has set aside from about 1.429 GHz to about 1.521 GHz, Europe has set aside from about 1.710 GHz to about 1.880 GHz and the United States has set aside from about 1.850 GHz to about 1.990 GHz. These different bandwidths all represent approximately 11%, or about 200 MHz of the total bandwidth set aside for PCN/PCS. The lower end of this overall bandwidth, 1.5 GHz is approximately two times higher than the standard frequency at which current cellular telephone systems operate at, namely 800 MHz.

The present invention is directed to low cost antennas for use in the ultra-high frequency operating ranges intended for PCN/PCS communications. Primarily, antennas for use in PCN/PCS communications will be mounted on vehicles to provide a mobile aspect to PCN/PCS. However, it is also envisioned that such antennas may be mounted on building window glass to further extend PCN/PCS services directly to a user's home or office. Both of these building and vehicle antennas will be of the glass mount type which will eliminate the need to drill holes through or otherwise modify a vehicle body or building wall.

Glass mount antennas typically utilize two modules which are mounted on the outside and inside surfaces of the window glass to transmit signals through the window glass between the opposing modules. The outside antenna module typically includes a vertically extending antenna radiating element, while the inside antenna module typically contains a connector or transmission feedline which may lead to a utilization device such as a telephone, pager, facsimile machine or the like. The outside and inside antenna module transmit RF signals between each other through the window glass. Loss occurs in glass mount antennas because they must transmit their signals through a dielectric material, such as the window glass and also must match the impedance of the outside antenna. Therefore, a window glass mount antenna typically has lower gain compared to a roof-mount, antenna which has a physical connection which extends through the vehicle body between inside and outside modules.

Previous glass vehicle cellular mobile telephone antennas have employed capacitive coupling in order to transmit RF signals through the glass of a vehicle window. In capacitively coupled antennas, two metal plates are positioned opposite each other on opposing surfaces of the window glass. These metal plates cooperate and act as a capacitor to transmit RF energy through the intervening window glass. Where the operating frequency of the communications system 800 Mhz, such as in a US cellular system, the metal plates are electrically small compared to the operating wavelength.

However, at the 1.5 GHz to 2.4 GHz frequency range of PCN/PCS, the RF signals begin to stray and the plates no longer act as capacitive couplers, but rather one of the metal plates acts as the primary radiating antenna element.

Capacitively coupled systems and associated impedance matching networks are generally described in U.S. Pat. No. 4,089,817, issued May, 1978 and U.S. Pat. No. 4,839,660, issued June, 1989. Capacitive coupling presents a number of disadvantages. As the operating frequency of the antenna enters the ultra-high frequency range, the electrically conductive plates must be increased in their size in comparison with the operating wavelengths to prevent any single one of the plates from becoming the primary radiating element in the antenna. Because the metal plates cannot be made large enough in comparison with the operating wavelength, a high impedance coupling of the nature of several hundred ohms occurs and cannot be avoided. This impedance will lead to high loss due to the leakage of the electrical field at high frequencies. In the ultra-high frequency bandwidth of PCN/PCS, even a small metal plate may no longer act as a capacitor element, considering the thickness of the vehicle glass and the stray capacitance. In such a situation, the circuit may bypass the signal and make it more difficult to match the high impedance of the antenna to the conventional 50 ohms of the utilization device, or telephone, used within the vehicle or building.

With the problems that occur at high operating frequencies, it is critical that an antenna system has a low pattern distortion. A conventional collinear array whip element does not have a uniform current distribution and the lower section of the whip typically exhibits the strongest radiation. When attached to a window of a vehicle, the lower section of the whip antenna element is blocked by the roof of the vehicle resulting in pattern distortion and deep nulls. At the 1.8 GHz of the PCN/PCS band, the situation becomes worse, because the length of the radiator element is typically only half that of those employed in the cellular bandwidth because of the doubling of the frequency.

A collinear array type whip antenna with a high feeding point may be provided by applying a decoupling sleeve or slot technology. This type of antenna typically has a 50 ohm to 75 ohm input impedance, which renders it difficult to adapt to capacitive coupling.

U.S. Patent Re. 33,743 describes a capacitively coupled antenna system for coupling a coaxial feedline through a window glass, using a ¼-wave antenna. However, at PCN/PCS frequencies, the ¼-wave antenna suggested by this patent will have a length of approximately 1.7 inches which for all intents and purposes will be disposed beneath the roofline of a vehicle and which will result in severe pattern distortion and deep nulls.

Another approach is described in U.S. Pat. No. 4,939,484 issued Jul. 3, 1980, which discloses a coupling arrangement in which helical conductors are housed within outer conductors and are used to couple the RF signals through a window glass. This patent indicates that the size of the helical conductors and their housings must be fixed to satisfy the object frequency. In the 800 MHz operating frequency associated with conventional cellular communications systems, the helical cavity is designed for 200 MHz. However, at the ultra-high frequencies intended for PCN/PCS, and specifically at about 1.8 GHz, the helical conductor must be designed for 600 MHz. At this size, a significant drop of unloaded Q will occur because of the small helical conductor and the coupling coefficient attained by such an arrangement will not be enough to retain the 11% bandwidth preferred for PCN/PCS. Moreover, the helical conductor approach described in this patent is difficult to tune and is further difficult to manufacture because of its complex, three-dimensional structure.

The performance of the prior art antenna assemblies described above will degrade considerably for frequencies higher than 1.5 GHz. Prior art antennas are relatively low frequency systems as compared to the ultra high frequencies intended for PCN/PCS, and they utilize low Q, lumped LC elements, or semi-lumped elements provided by incorporating an LC circuit placed in a metal enclosure. The loss of such an LC circuit will increase considerably due to the low Q nature of such an antenna when used at higher PCN/PCS frequencies. PCN/PCS communication systems must operate at low power levels of about one watt and must provide a very wide range of coverage at the ultra high frequencies which comprise the bandwidth of such systems. The minimum bandwidth is near to 11%, and prior art antennas are simply not appropriate for operation in the PCN/PCS band because of their low frequency approaches.

My co-pending patent application, Ser. No. 128,367, filed Sep. 28, 1993 describes one antenna system which overcome the problems and disadvantages described above which occur in the PCN/PCS band. In that application, an antenna system is described wherein the inner and outer modules are provided with hollow metallic cavities which contain high Q ceramic resonators which couple the signal through the glass. The operation of such a system is very well suited for PCN/PCS applications. However, the structure disclosed therein is relatively costly.

Accordingly, a need exists for a glass mount antenna system which can operate effectively at the ultra-high frequencies intended for PCN/PCS of about 1.5 GHz to about 2.4 GHz with minimum losses and which is relatively inexpensive and easy to manufacture. Microstrip antennas, and particularly slot fed antennas, have been described in the literature and offer some promise over the prior art capacitive and inductive coupling systems. Microstrip antennas typically include a microstrip antenna, such as a patch or printed dipole, located on one substrate which is affixed to another substrate upon which a microstrip feedline is located. A ground plane is defined between the two substrates and typically contains an aperture therein through which the antenna patch and feedline are coupled. Such an arrangement is described by Pozar in "Electronics Letters", Volume 21, Number 2, dated Jan. 17, 1985.

The present invention is directed to an antenna apparatus utilizing microstrip technology and particularly, planar cavity slot coupling which is capable of desirable performance characteristics at ultra-high frequencies associated with PCN/PCS in which two coupling members are provided with planar cavities and exciter strips and are placed on opposite sides of a window glass to provide a through glass antenna assembly. The prior art simply fails to teach an appropriate structure to allow microstrip transmission of electrical signals through a dielectric medium such as window glass.

Thus, an object of the present invention is to provide an improved glass mount antenna system which has comparable overall performance in the PCN/PCS bandwidth to a ceramic resonator approach, but with much lower cost and with some advantages.

It is another object of the present invention to provide a glass mount antenna system adapted to operate at ultra-high frequencies which exhibits greater coupling efficiency and less pattern distortion which may be easily fabricated.

It is still another object of the present invention to provide a glass mount antenna assembly adapted for use at PCN/PCS operation frequencies for installation on either a vehicle or building window which utilizes aperture coupling on opposing coupling members.

It is yet a still further object of the present invention to provide a glass mount antenna assembly having opposing, aligned inside and outside modules, the inside module being connected to a utilization device, such as a telephone, the outside module being connected to a radiating element, the utilization device and radiating elements being respectively electrically connected to inner and outer coupling members formed from printed circuit boards, each of the coupling members having a planar cavity defined on their innermost opposing surfaces, the cavities being generally aligned with each other on opposite surfaces of the window glass, the inner and outer coupling members further having, on their outermost surfaces, an exciter strip which crosses the slots.

It is still another object of the present invention to provide a glass mount antenna assembly which utilizes aperture coupling to transmit RF signals through a window, the antenna assembly including inside and outside antenna modules, each antenna module including distinctive coupling plates which oppose each other, the coupling plates each having a ground plane formed on a surface thereof with a coupling aperture defined therein, the coupling plates further having an exciter strip on opposite surfaces of the ground planes, the exciter strips being disposed thereon generally perpendicularly aligned to the coupling plate slots, the two ground planes being aligned in the resonant direction to minimize loss.

It is still yet another object of the present invention to provide an inexpensive antenna apparatus having outside and inside modules adapted for mounting on opposite surfaces of a window, each of the inside and outside modules having a coupling plate which includes a printed circuit board, the outside module coupling plate including a metallic coating on one surface thereof which forms a ground plane, and the coupling plate further including on its opposite surface, an exciter strip having an elongated stub portion which crosses the cavity and which further includes an extension portion thereof to form a T-bar style exciter strip, the inside module coupling plate also including a metallic ground plane with a planar cavity and a T-bar, or cross, exciter strip on the coupling plate opposing surface.

SUMMARY OF THE INVENTION

In accordance with these and other objects, the present invention provides a novel glass mounted antenna assembly which is adapted for operation in ultra-high frequencies set aside for PCN/PCS, namely about 1.5 GHz to about 2.4 GHz in conjunction with a utilization device, such as a telephone, within an area at least partially enclosed by a window, such as a vehicle or office or the like. The antenna apparatus comprises opposing inside and outside antenna modules, an elongated radiating element electrically connected to the outside antenna module, a coaxial feedline electrically connected to the inside antenna module. Means for transmitting RF signals between the inside and outside antenna modules are provided in the form of two planar coupling plates, one of the two coupling plates being disposed within the inside antenna module and electrically connected to the coaxial feed line and the other of the two planar coupling plates being disposed within the outside antenna module and electrically connected to the radiating element. Means are further provided for mounting the inside and outside antenna modules onto opposing respective inner and outer surfaces of the window.

The antenna apparatus of the present invention further utilizes slot coupling to provide a stable coupling system which is relatively insensitive to the thickness of the glass upon which it is mounted and which does not require subsequent tuning. In this regard, the two coupling plates of the antenna apparatus further comprise a pair of printed circuit (PC) boards respectively housed within the inside and outside antenna modules. The coupling plates generally oppose each other when the antenna modules are affixed to opposite sides of a window glass in general registration with each other.

The outside module PC board has a metallic coating forming a ground plane on one surface with a planar cavity formed therein. An impedance matching network is printed on the other surface of the PC board and provides a means for matching the impedance of the antenna with that of the utilization device. The network also includes an exciter strip which crosses the planar cavity disposed on the opposite side of the PC board. The inside module PC board also has a metallic coating disposed on one surface thereof to define a ground plane which is aligned with the metallic coating of the outside module PC board and further also has a planar cavity disposed therein. The opposite surface of this PC board contains a trace for connection to a utilization device feedline and also contains an exciter strip which crosses the cavity. The two antenna modules are applied to opposite surfaces of a window glass so that the planar cavities are aligned with each other. In this registration position, the PC boards also oppose each other.

The planar cavities define slots in the coupling plate opposing surfaces and preferably take the form of a U-slot configuration or a "dog-bone" configuration. The exciter strips are generally rectangular in profile, but may include a T-bar configuration when an ordinary PC board is used to provide a substrate for the PC boards.

In accordance with the present invention, cavity or slot fed coupling is accomplished at a minimum cost with reliable results obtained for a through-glass antenna assembly at the ultra-high frequencies intended for PCN/PCS.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of the description, reference will be made to the attached drawings in which.

DESCRIPTION OF THE PREFERRED EMBODIMENTS

Figure 1:
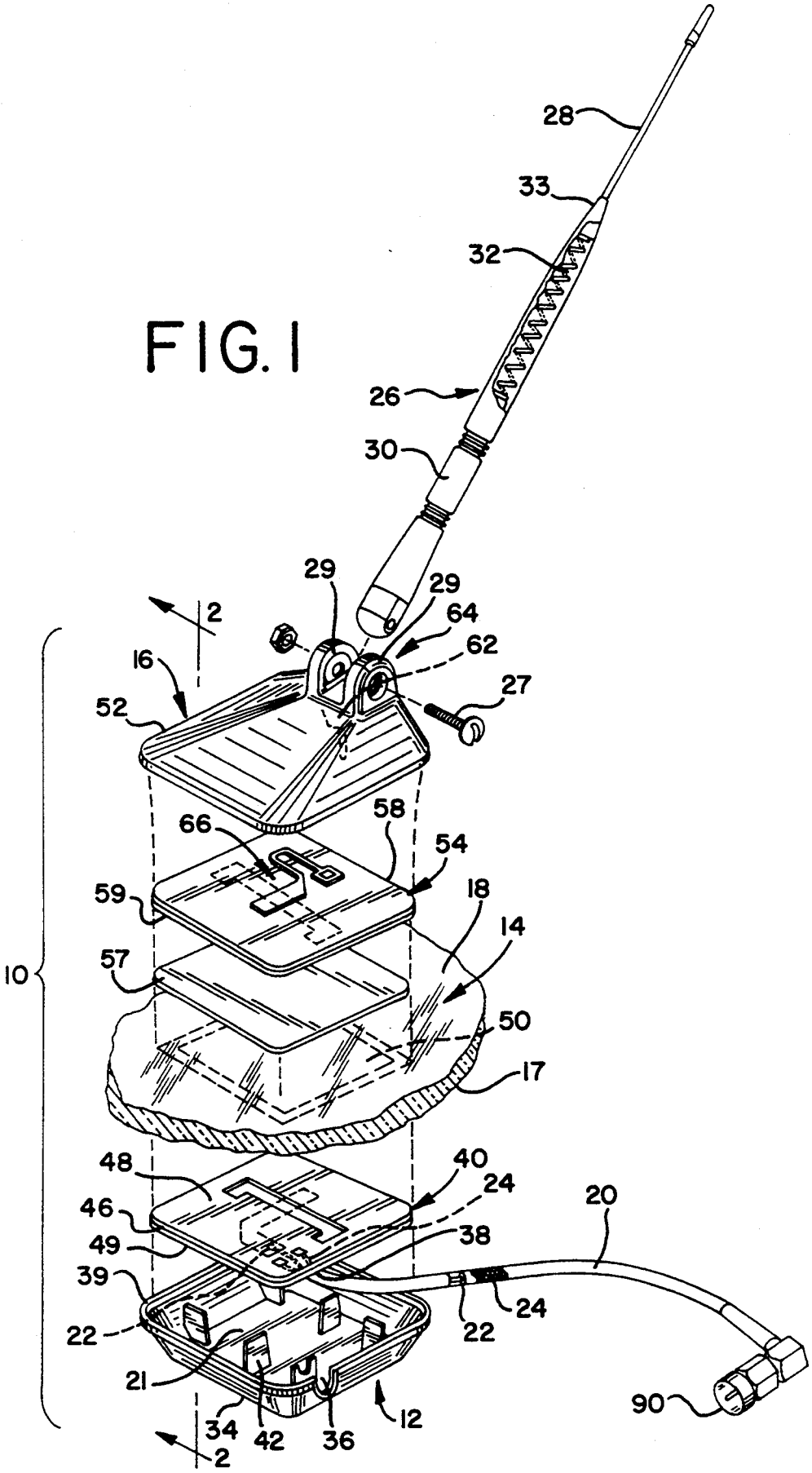
FIG. 1 is an exploded perspective view of an antenna assembly constructed in accordance with the principles of the present invention.
Figure 2:
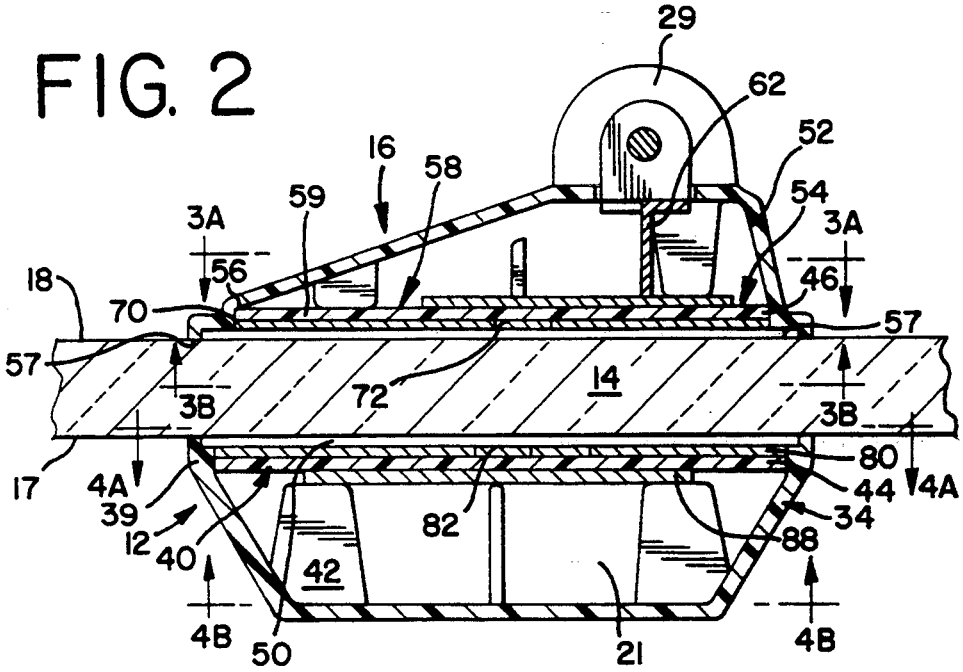
FIG. 2 is a cross-sectional view of the antenna assembly of FIG. 1 in place upon a window.

Referring to the Figures, and particularly to FIGS. 1–2, a first embodiment of a mobile telephone antenna apparatus 10 constructed in accordance with the principles of the present invention for use in a PCN/PCS communications system which operates in the frequency range of about 1.8 GHz to about 2.4 Ghz comprises generally an inside antenna module 12 for mounting on the inside surface 17 (FIG. 2) of a vehicle window glass 14, and an outside antenna module 16 for mounting on the outside surface 18 of the window glass 14 in registration with the inside module 12. Radio-frequency ("RF") signals are conveyed to and from the inside antenna module 12 by a coaxial feedline 20 having a central insulated conductor wire 22 and an intermediate conductor in the form of a shield 24 which runs the length of the feedline 20 in a concentric relationship with the central conductor wire 22. In accordance with conventional practice, both conductors 22, 24 extend from a utilization device, such as a cellular telephone (not shown) to the inside antenna module 12.

RF energy is radiated from the outside antenna module 16 by a generally vertical radiating element 26 which is rotatably mounted to the outside antenna module 16 by way of a screw 27 which extends between two opposing hubs 29 formed in the outside module housing.

The radiating element 26 is preferably of a collinear array type with an upper $\frac{1}{2}$- to $\frac{5}{8}$-wavelength radiator 28 arranged in line with a $\frac{1}{2}$-wavelength lower radiator 30. These two radiators 28, 30 of the radiating element 26 are interconnected and separated by a phasing coil 32 which is encapsulated by a plastic covering 33. Although the lower radiating element 30 is not the primary focus of the invention, it has been found, through testing, that a diameter of the lower radiating element of between 7 to 9 mm is easily matched with a simple transmission line impedance matching network of sufficient bandwidth to provide a broadband $\frac{1}{2}$- or $\frac{5}{8}$-wavelength over a $\frac{1}{2}$-wavelength collinear array. A $\frac{1}{2}$-wavelength lower radiator having a certain L/D ratio (length to diameter) and a simple transmission line impedance matching network will improve the overall bandwidth. For preferred results, approximately a 4/9-wavelength lower radiator is utilized.

The inside antenna module 12 includes a housing 34 which is formed from a suitable plastic by a conventional injection molding process. The inside module housing 34 includes a elongated cradle portion 36 which receives and partially supports one end 38 of the coaxial feedline 20 and defines a passage through the sidewall of the housing 34 into an internal cavity 21 of the inside antenna module 12. The housing 34 also includes a ridge, or support lip 39, formed therein which supports an inside coupling plate 40. Additional means for supporting the inner coupling plate 40, such as support members 42 may further be disposed in the housing 34 as illustrated in FIG. 2. The support members 42 have a height sufficient to contact the inside coupling plate 40 and support the same in its registration with housing lip 39.

The inside coupling plate 40 preferably includes a printed circuit (PC) board 44 having a body portion 46 formed from a suitable dielectric material which defines two opposing coupling plate planar surfaces 48, 49. The inner coupling plate 40 may be bonded to the inside housing 34 by an adhesive to retain it in place and to form a unitary inside antenna module. Means for adhering the inside module to the inner surface 13 of the window glass 14 is also provided in the form of a conventional double-sided adhesive pad 50 which is applied to surface 48 of the coupling plate 40.

The outside antenna module 16 is constructed in a similar manner as the inside antenna module 12, in that it includes a plastic exterior housing 52 having an interior lip 56 extending around its perimeter which supports an outer coupling plate 54 therein. The outer coupling plate 54 also preferably takes the form of a PC board 58 having a body portion 59 with two opposing planar surfaces 60, 61. The PC board fills an open end portion of the outside module 16 to define an internal cavity 72 therein. The outside module 16 also includes a means for affixing the module 16 to the window outer surface 18, such as a double-sided adhesive pad 57.

The outer coupling plate 54 is electrically connected to the radiating element 26 by way of an antenna module clip 62 which forms a part of the outside module antenna element engagement hubs 29 and extends into the outside antenna module 16 into contact with the outer coupling plate 54. The outer surface 60 of the outer coupling plate 54 may contain a circuit 66 which may be etched into the metallic coating 70 and which is electrically connected to the clip 62 to provide an electrical connection between the outer coupling plate 54 and the radiating element 26.

In an important aspect of the present invention, and as best illustrated in FIGS. 2 through 4B, the two coupling plates 40, 54 of the two antenna modules 12, 16 incorporate a means for slot coupling rather than conventional capacitive or inductive coupling. In this regard, the two coupling plates 40, 54 are each provided with an electrically conductive coating 70, 80 thereon, preferably a copper coating having a cavity, or slot 72, 82 formed therein. Focusing on the outside antenna module coupling plate 54, the conductive coating 70 is disposed upon the inner surface 61 of the PC board 54 and a cavity 72 is disposed in the general central portion thereof. The cavity 72 is illustrated as having a U-shaped configuration with two opposing ends 73, 74 interconnected by an elongated, intermediate web portion 75. This cavity 72 is planar in nature and occurs the PC board surface 61 where the copper has been removed. Accordingly, the planar cavity 72 has a depth which is equal to the thickness of the metallic coating 70. The cavity 72 may be most easily formed on the PC board 58 by a suitable photoetching process commonly employed in the manufacture of printed circuit boards.

Figure 3A:
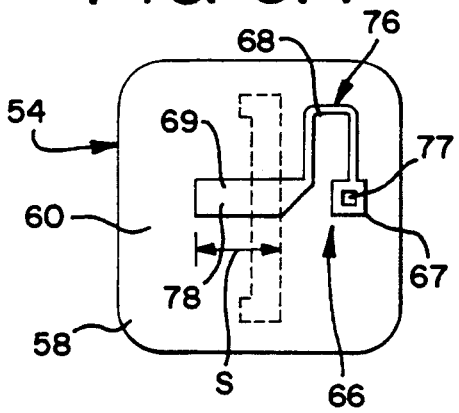
FIG. 3A is a plan view of the outer coupling plate of the antenna assembly of FIG. 2, taken along lines 3A—3A thereof and viewing at the upper surface thereof.
Figure 3B:
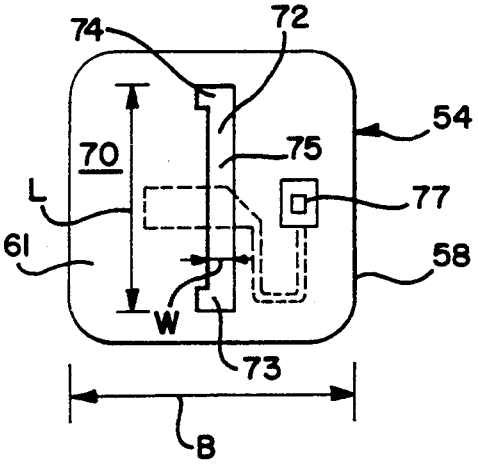
FIG. 3B is a plan view of the outer coupling plate of the antenna assembly of FIG. 2, taken along lines 3B—3B thereof and illustrating the bottom surface thereof.
Figure 4A:
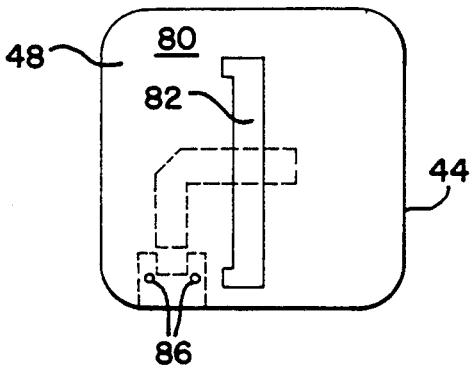
FIG. 4A is a plan view of the inner coupling plate of the antenna assembly of FIG. 2, taken along lines 4A—4A thereof and illustrating at the upper surface thereof.
Figure 4B:
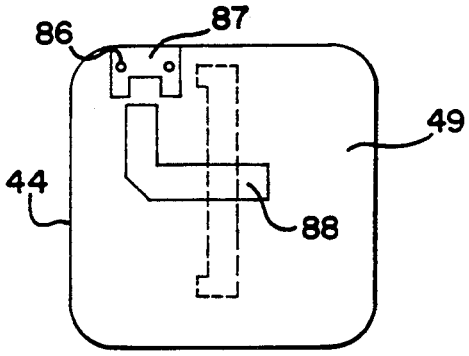
FIG. 4B is a plan view of the outer coupling plate of the antenna assembly of FIG. 2, taken along lines 4B—4B thereof viewing the bottom surface thereof.

On the opposite surface 60 of the outside antenna module coupling plate 54, a circuit 66 is formed in a similar manner thereon in general alignment with the cavity 72. This circuit 66 includes three trace members 67, 68 and 69 which define a F-type (Gamma-type) impedance matching network 76 as illustrated and an exciter, or feedline strip 78. The impedance matching network portion 76 of the circuit 66 includes a microstrip circuit formed by trace members 67 and 68. The exciter strip 78 has a characteristic impedance ranging from about 40 ohms to about 50 ohms. Trace member 67 has an impedance of about 80 to about 125 ohms and it cooperates with the interconnecting clip 62 to introduce a stray capacitance into the circuit 66. The circuit 66 at one end portion thereof also includes an elongated exciter strip 78 (trace member 69) which is positioned on the coupling plate outer surface 60 in registration with the cavity 72 so that it intersects and crosses the cavity 72, when viewed through the PC board 58. This relationship is illustrated in FIG. 3A and FIG. 3B which are plan views of the PC board 58 looking downwardly and upwardly, respectively. Trace member 67 includes an aperture 77 therein which extends through the PC board 58 and provides a point at which the antenna clip 62 may be connected, such as by solder, to the PC board 58. Because the outer coupling plate 54 is formed from a PC board and the trace members 67–69 serve as inductors and capacitors, antenna assemblies of the present inventions are much cheaper to produce than if conventional capacitors and inductors of equivalent rating were used.

Turning now to the inside antenna module 12, its associated PC board 44 also has an electrically conductive coating on its surface 48 oriented within the inside module housing 34 so that it faces outwardly, i.e., so that its outer surface 48 will oppose the inner surface 61 of the outside module PC board 58. This surface 48 also has a planar cavity 82 disposed in the general central portion thereof and substantially surrounded by the conductive coating. The opposite, or innermost surface 49 of the PC board 44 contains a microstrip exciter or feedline 84 which extends from a connection area to cross the cavity 82 as illustrated. The center conductor 22 of the feedline 20 is attached to the feedline 84 and is preferably soldered thereto. The coaxial shield conductor 24 is separated into pigtails and soldered to the ground plane of the PC board through two apertures 86 and which are surrounded by metallic plated portions 87. The other end 90 of the coaxial feedline 20 is suitably adapted for connection to a PCN/PCS utilization device. The length of the PC board, that is, the dimension B, which is perpendicular to the planar cavity is preferably chosen to be slightly larger than a free space $\frac{1}{4}$-wavelength but less than a waveguide $\frac{1}{2}$-wavelength to avoid resonance at the frequency when the dielectric characteristics and thickness of the adhesive-glass-adhesive interface is considered.

The two metal coatings 70, 80 of the opposing surfaces 48, 61 of the coupling plates 40, 54 serve as ground planes and therefore the planar cavities 72, 82 act as radiating elements with the two spaced-apart planar cavities acting as a complement of a dipole. In using a rectangular slot cavity, it has been determined that such cavities do not possess enough coupling coefficient for reliable use. The dog-bone cavity configuration described by Pozar provides a high coupling coefficient for low dielectric materials such as foam or plastic. However, for a higher dielectric interface, such as the adhesive-glass-adhesive interface which will be most commonly used in PCN/PCS, such configurations have been found to be overcoupled. Testing has resulted in a modified dog bone end loading which yielded the U-shaped cavity, or slot, illustrated in FIGS. 1–4B and it was found that such a configuration provided an appropriate coupling coefficient for window glasses ranging from about 3.5 mm to about 6 mm in thickness and further yields less mutual coupling with wires of a vehicle in-glass window defroster unit due to the slim cavity size.

It is desirable to have the exciter strip aligned with the center of the cavity because it has been found that the coupling of the two modules may be reduced as the exciter strip is offset from the center thereof. The exciter strips preferably should cross their associated cavities at a right angle such that the cavities and exciter strips are perpendicular to each other. In order to satisfy the minimum bandwidth requirement for PCN/PCS, which is about 11%, the aperture should have a width to length ratio (W:L) of about 0.1 to about 0.14, with preferred results being obtained when the W:L ratio is about 0.1. In the preferred embodiment, the planar cavity should have a length which is about 0.16- to 0.18 wavelength. In order to attain preferred impedance matching, the exciter strip should preferably possess a matching stub which extends across the aperture by about 5 mm to about 7.5 mm. This extension distance is represented by the line S in the Figures.

The PC boards are preferably formed from a dielectric material. One dielectric material which has produced desirable results is a ceramic-filled PTFE (Teflon) material sold for microwave substrate applications under the trade name RO3003 High Frequency Circuit Material by Rogers Corporation of Chandler, Ariz. This RO3003 material is sold with an exterior electrically conductive copper coating in place on both surfaces thereof. PC boards utilizing approximately 1 ounce of copper per side for a full sheet (measuring 18×24 inches) have a coating thickness of approximately 35 μm thereon which permits reliable forming of the planar cavities therein utilizing a suitable conventional PC photoresist etching process.

Figure 5:
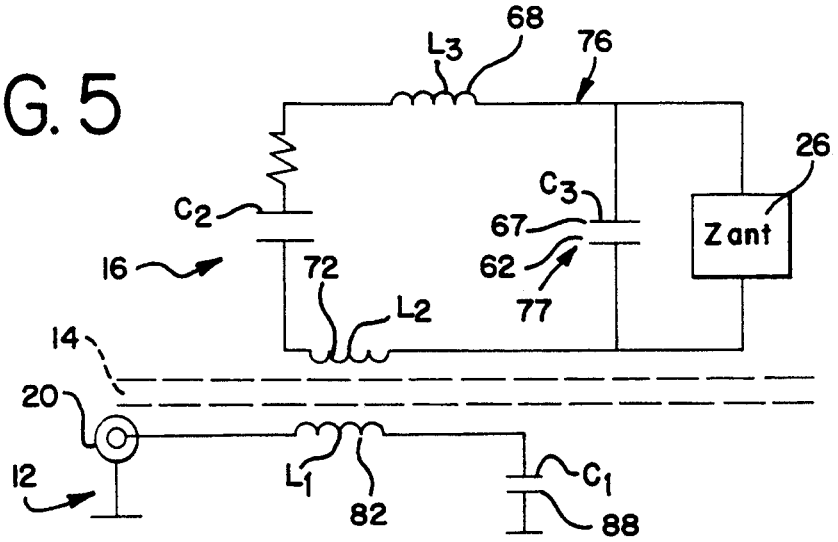
FIG. 5 is a schematic diagram of the antenna assembly of FIG. 1.
Figure 6:
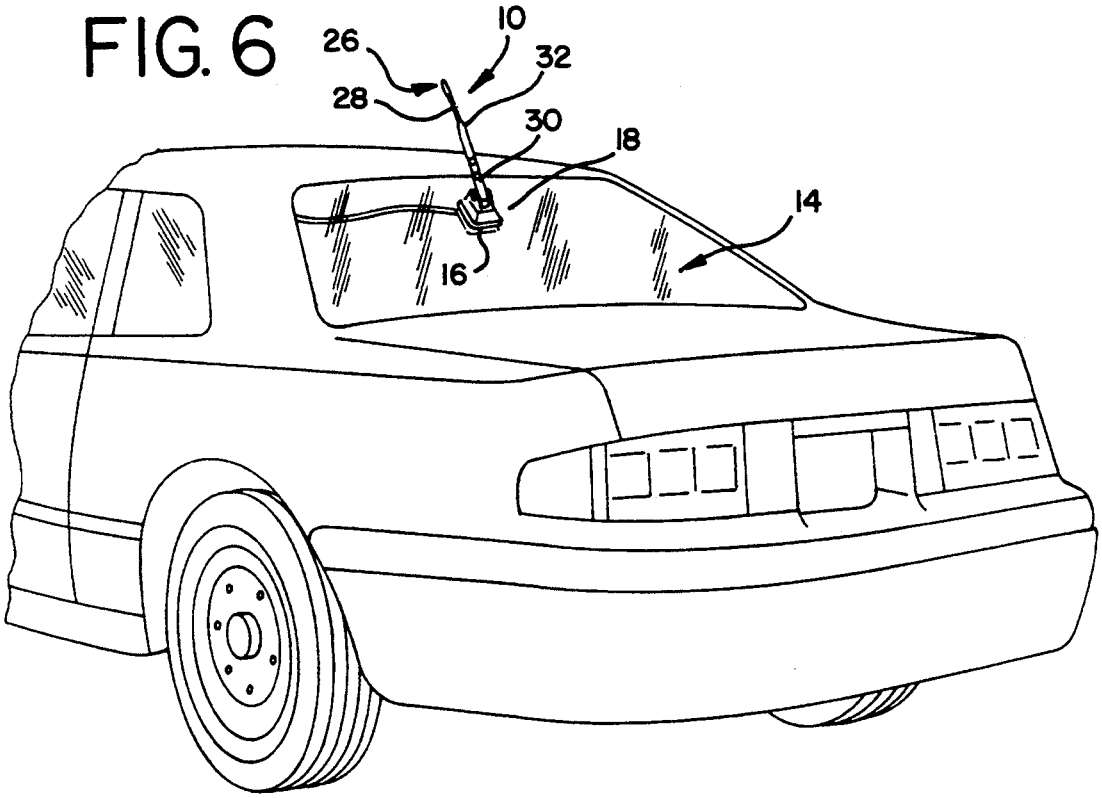
FIG. 6 is a perspective view of the antenna assembly of FIG. 1 in place upon the rear window of a vehicle.

FIG. 5 describes a simplified schematic diagram of the antenna apparatus provided by the present invention in terms of equivalent circuitry. In this regard, the Γ-type impedance network 76 is represented by $L_3$ and $C_3$ in which $L_3$ represents trace element 68 and $C_3$ represents the combination of trace element 67, the antenna clip 62 and the PC board-clip connection aperture 77. $Z_{ant}$ represents the antenna impedance which is matched by the impedance matching network described above. $C_2$ represents the exciter strip 78 whereas $L_2$ represents the PC board planar cavity 72. As to the inside antenna module, $L_1$ represents the inner coupling plate planar cavity 82 and $C_1$ represents the inner coupling plate exciter strip 88.

Figures 7, 7A:
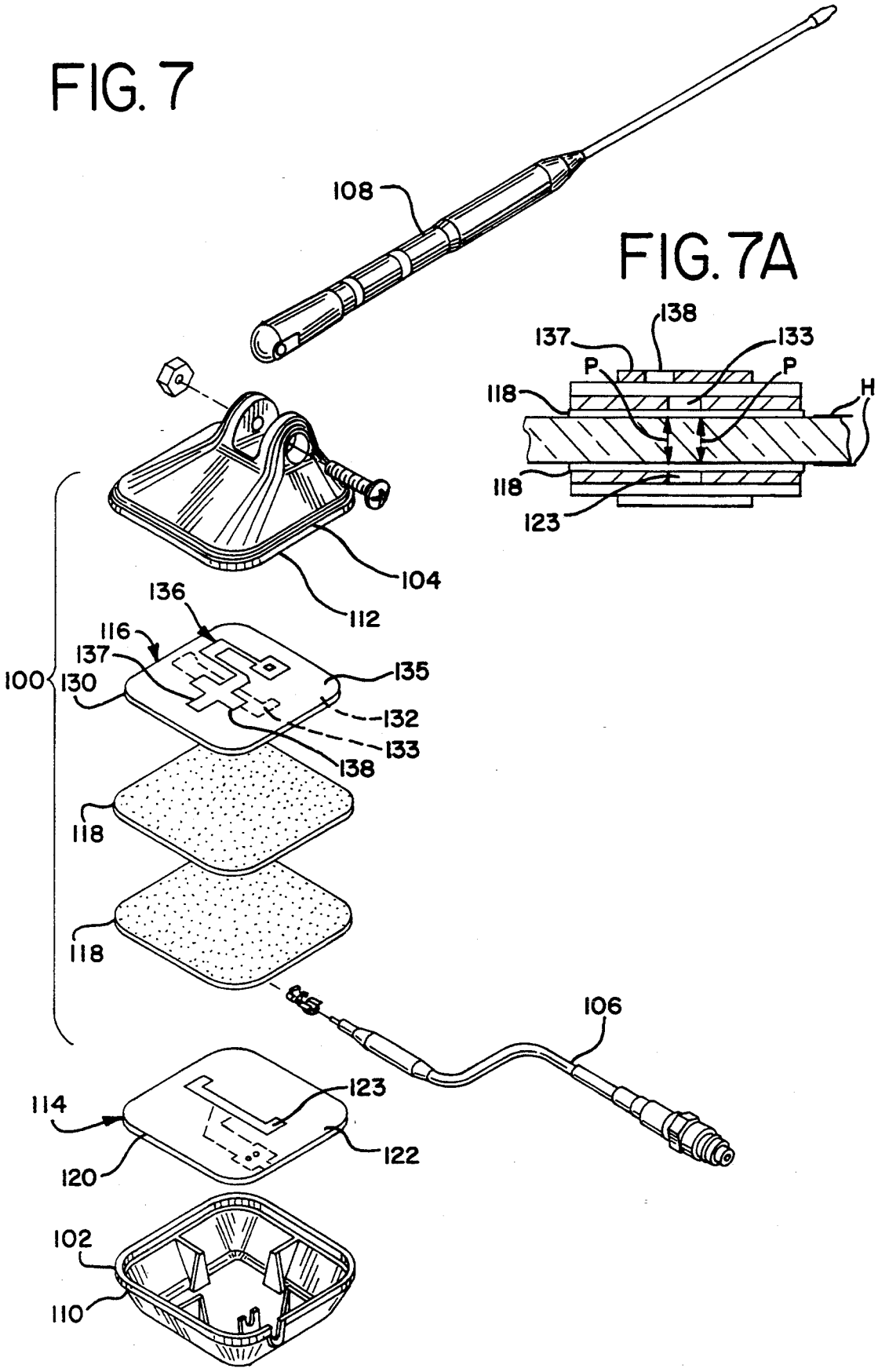
FIG. 7 is an exploded perspective view of an alternate embodiment of an antenna assembly constructed in accordance with the principles of the present invention.
FIG. 7A is an enlarged partial sectional view of the coupling plates of the antenna assembly of FIG. 7 in place upon a vehicle window illustrating the alignment of the coupling plate planar cavities.

FIG. 7 illustrates another embodiment 100 of the present invention having an inside module 102, and an outside module 104, a coaxial feedline 106 and an external radiating element 108. Each module 102, 104 includes a plastic housing 110, 112 which in turn includes respective inner and outer coupling plates 114, 116 and adhesive pads 118. The coupling plates 114, 116 each include PC boards 120, 130 having a ground plane surface 122, 132 with a cavity 123, 133 disposed therein and the central portion of a metallic coating 124, 134 disposed thereon. FIG. 7A illustrates a preferred alignment of the two coupling plates where the planar cavities are electrically parallel with each other (i.e., along lines H) and where the planar cavities 123, 133 are substantially geometrically aligned with each other as separated by the line P. The planar cavities 123, 133 may be slightly offset from alignment with each other with only a minor drop in performance.

Up until this point, the structure of this embodiment is much the same as that described above and illustrated in FIGS. 1–4B. The PC board exciter surfaces 125, 135 include exciter strips 126, 136 having a T-bar, or cross, configuration wherein the exciter strip stubs 127, 137 include an elongated crossing portion 128, 138. The exciter strip location is generally disposed at the center portion of the cavities 123, 133 which appear in the ground plane surfaces 122, 132 of the PC boards. The outside module exciter strip extension may be approximately 4 mm wide by approximately 21 mm long while the inside module exciter strip extension may be approximately 4 mm wide by approximately 20 mm long.

Figure 8:
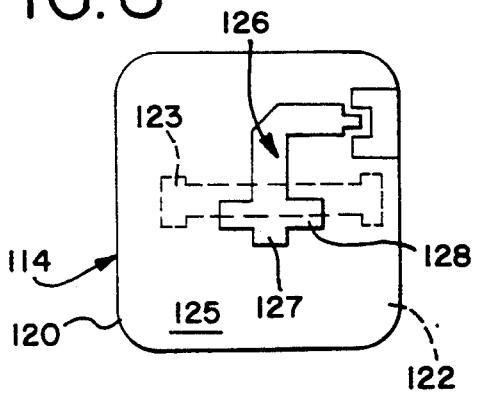
FIG. 8 is a plan view of an alternate outer coupling plate and illustrating the upper surface thereof.
Figure 9:
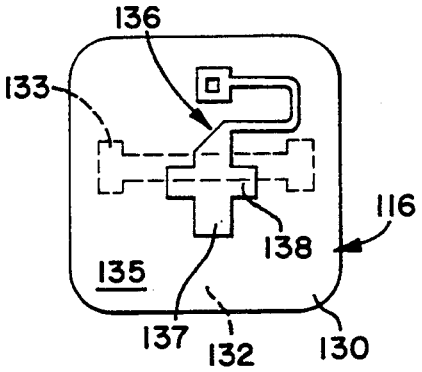
FIG. 9 is a plan view of an alternate inner coupling plate and illustrating the lower surface thereof.

This T-bar exciter strip extension 128, 138 improves the through-glass loss of the apparatus by increasing the amount of coupling when used in conjunction with the U-slot planar cavities of FIG. 7 or with the dog-bone shaped planar cavities of FIGS. 8 and 9. In testing, a 0.4 dB improvement was obtained regardless of whether the planar cavity 123, 133 possessed either a U-type configuration as shown or a dog-bone configuration. It is believed that the extension increases the reaction between the exciter strip in the planar cavity and blocks the backwards radiation to thereby increase the amount of coupling and reduce the radiation loss. Additionally, it has been discovered in using the T-bar configuration, a regular PC board substrate, such as FR-4 epoxy-fiberglass printed circuit board may be used as a substrate for the PC boards 120, 130 and a somewhat reduced, but acceptable the same performance is obtained as the apparatus using the Rogers RO3003 PC board described on the first embodiment 10 where the exciter strip does not include a T-bar or cross extension.

Figure 10:
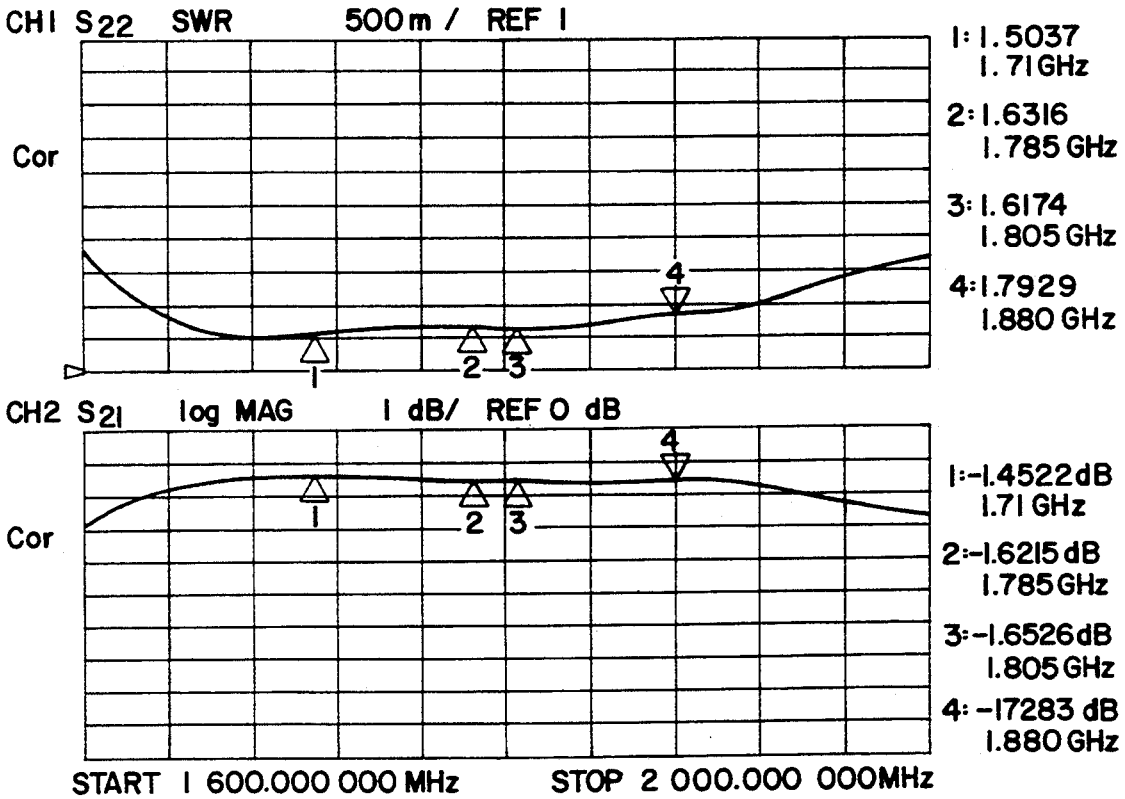
FIG. 10 is a graphical plot illustrating the input VSWR and transmission loss plots of the antenna assembly of FIG. 1.

FIG. 10 is a plot of the performance characteristics of the antenna assembly of FIG. 1, and illustrates the input VSWR on the top portion and transmission loss on the bottom portion. The antenna was analyzed over the range from 1.6 GHz to 2.0 GHz and points were plotted as indicated between 1.71 GHz and 1.88 GHz. This plot was for an antenna assembly mounted on a vehicle glass approximately 3.8 mm thick and using the Rogers RO3003 material referred to above as the dielectric material for the PC board and using 3M adhesive pads. The planar cavities of this assembly were the U-slots shown in FIGS., 1–4B and were oriented such that extending in opposite directions. As can be seen from FIG. 10, the antenna experienced less than a 2 dB loss.

Figure 11A:
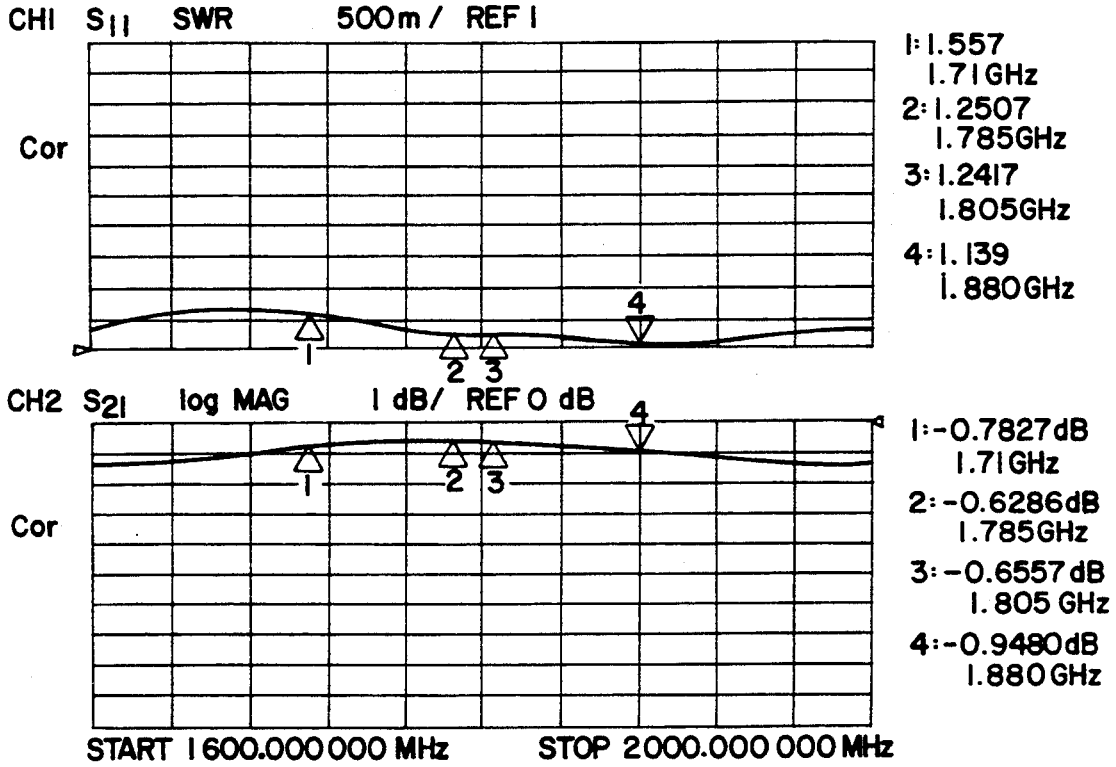
FIG. 11A is a graphical plot illustrating the input VSWR and transmission loss plots of the antenna assembly of FIG. 78; and, FIG. 11B is another graphical plot of an antenna assembly using the alternate coupling plates of FIGS. 8 and 9 and illustrating input VSWR and transmission loss.

FIG. 11A is a plot of the same performance characteristics of the antenna assembly of FIG. 7 in place upon a vehicle glass approximately 4.7 mm thick and using a Teflon-fiberglass woven material known as Ultralam 2000 and having a 60 mil thickness. This antenna assembly utilized U-slot planar cavities and T-bar style exciter strips. Performance was measured from 1.6 GHz to 2.0 GHz with data points plotted between 1.71 GHz and 1.88 GHz and the VSWR was lowered over the entire frequency range as compared to the antenna assembly of FIG. 10. The signal loss using the T-bar exciter strip was reduced to order 1 dB. This T-bar exciter strip improves the performance up to about 0.4 dB.

Figure 11B:
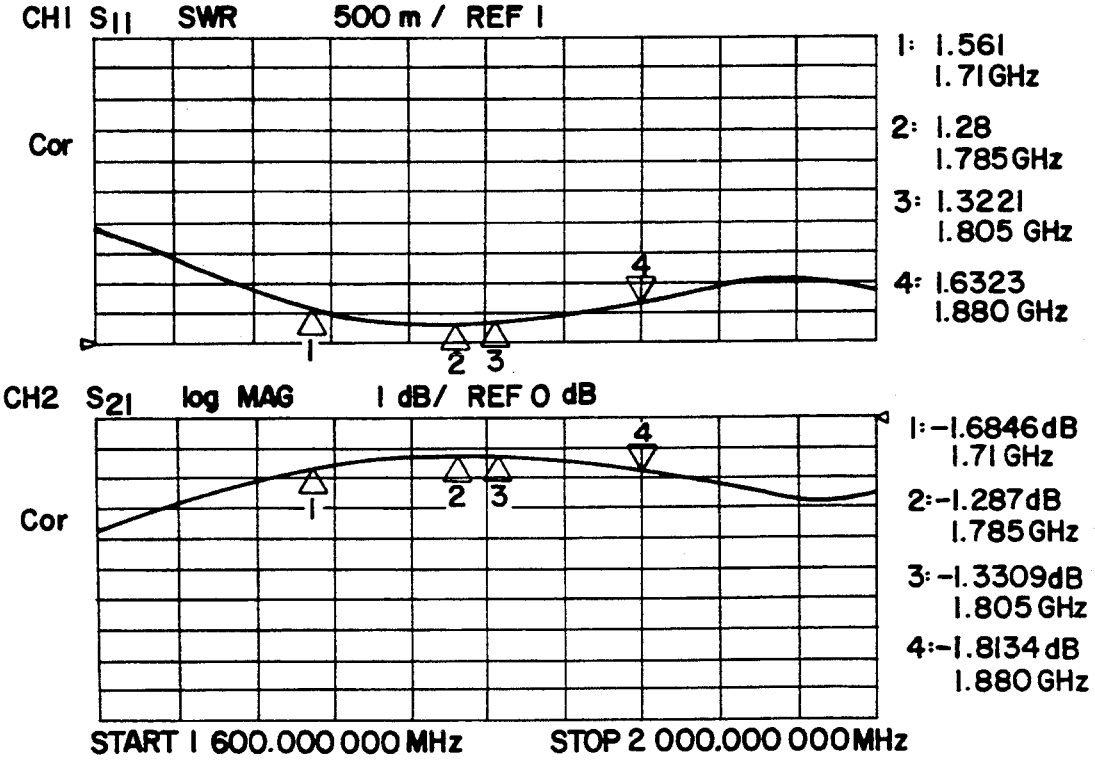

FIG. 11B is a performance plot of an antenna assembly using the coupling plates illustrated in FIGS. 8 and 9 utilizing dog-bone style planar cavities and T-bar exciter strips. The dielectric material for the PC boards has a FR-4 epoxy fiberglass composition. This PC board composition is less expensive than either the Rogers RO3003 or Teflon Ultralam material used in the plots of FIGS. 10 and 11A, but traditionally has incurred a much higher loss than those materials above 1.5 GHz. However, as FIG. 11B illustrates, the T-bar exciter strip renders the antenna acceptable.

It will be appreciated that the embodiments of the present invention which have been discussed are merely illustrative of some of the applications of this invention and that numerous modifications may be made by those skilled in the art without departing from the true spirit and scope of this invention.

We claim:

1. An antenna apparatus for mounting on a window and adapted for operation in the ultra-high frequency range of greater than or equal to about 1.5 GHz in conjunction with a utilization device, comprising:

an elongated radiating element having an electrical length of at least ½ wavelength;

a first housing for engaging an outer surface of the window, the first housing having means for supporting the radiating element thereon;

a second housing for engaging an inner surface of said window;

a first coupler disposed in said first housing and electrically connected to said radiating element, the first coupler including a planar member having first and second opposing surfaces, the first surface having an electrically conductive material disposed thereon which defines a ground plane of said first coupler, said first surface further having a planar cavity disposed thereon, the cavity being substantially surrounded by said conductive material, the second surface having an electrically conductive exciter strip disposed thereon in registration with said first surface planar cavity;

a second coupler electrically connected to said utilization device, the second coupler including a planar member having opposing first and second surfaces, the first surface also having an electrically conductive material disposed thereon to define a ground plane for said second coupler, said first surface also having a planar cavity disposed therein and being substantially surrounded by said conductive material, said planar member second surface having an exciter strip formed from a conductive material disposed thereon in alignment with said second coupler planar cavity and generally perpendicular thereto;

impedance matching means disposed within said first housing and connected between said first coupler exciter strip and said radiating element;

connection means comprising a coaxial cable extending into said second housing and having within said second housing a central conductor electrically connected to said second coupler exciter strip and a shielded conductor connected to said second coupler ground plane; and said first and second coupler first surfaces being generally disposed opposite each other on said outer and inner surfaces of said window.

2. An antenna apparatus as defined in claim 1, wherein said first and second coupler planar cavities are electrically parallel to each other.

3. An antenna apparatus as defined in claim 1, wherein said first and second coupler planar cavities are geometrically aligned with each other.

4. An antenna apparatus as defined in claim 1, wherein said impedance matching means includes a plurality of traces of conductive material disposed upon said first coupler member second surface.

5. An antenna apparatus as defined in claim 4, wherein said impedance matching means includes a Γ-type impedance matching network.

6. An antenna apparatus as defined in claim 1, wherein each of said planar cavities includes a U-slot.

7. An antenna apparatus as defined in claim 1, wherein at least one of said first and second coupler exciter strips has an elongated crossing portion oriented perpendicular to said exciter strip.

8. An antenna apparatus as defined in claim 1, wherein each of said planar cavities has a width to length ratio of about 0.1 to about 0.14.

9. An antenna apparatus as defined in claim 1, wherein each of said planar cavities includes a dog-bone slot.

10. An antenna apparatus as defined in claim 1, wherein each of said first and second coupler planar members includes a printed circuit board.

11. An antenna apparatus as defined in claim 1 where each of said first and second coupler exciter strips include stub portions which cross the planar cavities associated with said first and second planar members and said exciter strip stubs extend across said planar cavities about 5 mm to about 7.5 mm.

12. In a glass-mountable antenna assembly having an antenna radiating element, an outer antenna base member supporting the radiating element, an inner base member which supports a feedline from a utilization device, the improvement comprising:

a pair of coupling members disposed in said respective outer and inner base members, each coupling member having a planar body with two opposing surfaces, the first of said two surfaces having a conductive material coating thereon and a planar cavity disposed therein, the conductive metal coating providing a ground plane for each of said coupling members, the second of said opposing surfaces each having an exciter strip of conductive material disposed thereon in an electrically parallel and generally geometrically perpendicular relationship to said first surface planar cavities, said feedline being electrically connected to said coupling member of said inner base member and said radiating element being electrically connected to said coupling member of said outer base member.

13. The glass mountable antenna assembly as defined in claim 12, wherein said planar cavities include U-slots.

14. The glass mountable antenna assembly of claim 12, wherein said planar cavities include dog-bone slots.

15. The glass mountable antenna assembly of claim 12, wherein each of said exciter strips has an elongated stub of a defined width which extends across said planar cavities.

16. The glass mountable antenna assembly of claim 15, wherein each exciter strip stub extends over said planar cavity for a range of about 5 mm to about 7.5 mm.

17. The glass mountable antenna assembly as defined in claim 15, wherein said exciter strips having a generally cross-style configuration in which an elongated trace crosses a body of said exciter strips.

18. The glass mountable antenna assembly of claim 12, wherein said exciter strips include elongated traces of conductive material.

19. The glass mountable antenna assembly as defined in claim 12, wherein said planar cavity has a width to length ratio of about 0.1 to about 0.14.

20. The glass mountable antenna assembly of claim 12, wherein the second of said opposing surfaces of the coupling member disposed in said outer base member includes a plurality of traces thereon which form a Γ-type impedance matching network and which is connected to said antenna radiating element.

* * * * *